US011192675B2

(12) United States Patent
Snedecor et al.

(10) Patent No.: US 11,192,675 B2
(45) Date of Patent: Dec. 7, 2021

(54) LABEL APPLYING APPARATUS AND METHODS OF USE

(71) Applicant: ID Technology LLC, Ft. Worth, TX (US)

(72) Inventors: Mark T. Snedecor, Fort Worth, TX (US); Mark N. Bowden, Nokomis, FL (US); John A. Roe, Hewitt, NJ (US)

(73) Assignee: ID TECHNOLOGY LLC, Fort Worth, TX (US)

( * ) Notice: Subject to any disclaimer, the term of this patent is extended or adjusted under 35 U.S.C. 154(b) by 0 days.

(21) Appl. No.: 16/891,175

(22) Filed: Jun. 3, 2020

(65) Prior Publication Data

US 2020/0407099 A1 Dec. 31, 2020

Related U.S. Application Data

(60) Provisional application No. 62/866,927, filed on Jun. 26, 2019.

(51) Int. Cl.

| | |
|---|---|
| ***B65C 11/02*** | (2006.01) |
| ***B65C 9/00*** | (2006.01) |
| ***B65C 9/30*** | (2006.01) |
| ***B65C 9/46*** | (2006.01) |

(52) U.S. Cl.

CPC ..... *B65C 11/0215* (2013.01); *B65C 9/0006* (2013.01); *B65C 9/30* (2013.01); *B65C 9/46* (2013.01)

(58) Field of Classification Search

CPC ... B65C 9/0006; B65C 9/1865; B65C 9/1876; B65C 9/30; B65C 9/46; B65C 11/021; B65C 9/02; B65C 9/36

See application file for complete search history.

(56) References Cited

U.S. PATENT DOCUMENTS

| | | | |
|---|---|---|---|
| 2,015,597 | A | 9/1935 | Holm |
| 2,858,954 | A | 11/1958 | Tuthill |
| 3,536,550 | A | 10/1970 | von Hofe |
| 3,779,829 | A | 12/1973 | Wolff |
| 4,029,537 | A | 6/1977 | Kish |
| 4,080,239 | A | 3/1978 | Real et al. |
| 4,124,429 | A | 11/1978 | Crankshaw |
| 4,242,167 | A | 12/1980 | Hoffmann |
| 4,261,788 | A | 4/1981 | McClung |

(Continued)

FOREIGN PATENT DOCUMENTS

| | | | |
|---|---|---|---|
| EP | 0103652 | A1 | 3/1984 |
| GB | 2456511 | A | 7/2009 |

*Primary Examiner* — George R Koch

(74) *Attorney, Agent, or Firm* — Thompson Hine LLP

(57) ABSTRACT

A method of printing and applying a label to an item moving in a conveyance direction along a conveyance path involves: utilizing a print and labeling assembly that includes a label stock path that feeds label stock past a printer to print on a label of the label stock to produce a printed label that is dispensed in a first direction onto a label applying belt that moves in a second direction, wherein the first direction is substantially perpendicular to the second direction such that the printed label moves onto the label applying belt from a lateral side of the label applying belt; and the label applying belt moves the printed label into position to engage with the item as it moves along the conveyance path. A label print and apply system and apparatus is also provided.

19 Claims, 11 Drawing Sheets

(56) References Cited

U.S. PATENT DOCUMENTS

| | | | |
|---|---|---|---|
| 4,390,390 | A | 6/1983 | Margraf et al. |
| 4,558,653 | A | 12/1985 | Horton et al. |
| 4,619,726 | A | 10/1986 | Cook et al. |
| 4,680,082 | A | 7/1987 | Kearney |
| 4,944,827 | A | 7/1990 | Lilly et al. |
| 5,399,228 | A | 3/1995 | Schroeder et al. |
| 5,587,043 | A | 12/1996 | Hying et al. |
| 5,660,676 | A | 8/1997 | Brooks |
| 6,368,446 | B1 | 4/2002 | McNestry |
| 6,378,588 | B1 | 4/2002 | Nixon et al. |
| 6,511,569 | B1 | 1/2003 | Nixon et al. |
| 6,596,105 | B2 | 7/2003 | Kendal, Jr. |
| 6,640,865 | B1 | 11/2003 | Morikawa |
| 6,768,502 | B2 | 7/2004 | Milton |
| 7,469,736 | B2 | 12/2008 | Fries et al. |
| 7,757,739 | B2 | 7/2010 | Fries et al. |
| 8,033,312 | B2 | 10/2011 | Fries et al. |
| 8,186,408 | B2 | 5/2012 | Fries et al. |
| 8,756,124 | B1 | 6/2014 | Sayers, III et al. |
| 8,936,841 | B2 | 1/2015 | Katarya et al. |
| 9,008,815 | B2 | 4/2015 | Popp |
| 9,195,228 | B2 | 11/2015 | Popp |
| 9,483,496 | B1 | 11/2016 | Washburne et al. |
| 10,106,286 | B2 | 10/2018 | Snedecor |
| 10,287,050 | B2 | 5/2019 | Roe |
| 2002/0096261 | A1 | 7/2002 | Yang |
| 2006/0277269 | A1 | 12/2006 | Dent |
| 2007/0074809 | A1 | 4/2007 | Phillips |
| 2009/0126850 | A1 | 5/2009 | Fletcher |
| 2011/0030890 | A1* | 2/2011 | Cumberland ..... B65C 9/34 156/249 |
| 2016/0214360 | A1* | 7/2016 | Snedecor ..... B65C 9/0006 |
| 2017/0152070 | A1 | 6/2017 | Roe |
| 2018/0203650 | A1* | 7/2018 | Le ..... B65C 9/40 |
| 2018/0305061 | A1 | 10/2018 | Vicktorius |

* cited by examiner

LABEL APPLYING APPARATUS AND METHODS OF USE

TECHNICAL FIELD

The present application relates generally to labeling devices and more particularly to devices for printing labels and labeling items as the items are conveyed along a path.

BACKGROUND

Material handling systems are used many different industries and often include complex packaging and conveyor systems that convey items quickly from one place to the next within a facility or multiple facilities. Labeling is often necessary to convey information about the items so that the items can be identified, categorized, and/or properly routed, among other reasons. Placing labels on items that are moving along a conveyance path within a material handling system presents unique challenges, which industry has sought to overcome by using complex electro-mechanical or electro-pneumatic systems that rely on many moving parts and a high degree of complexity. Examples of these existing systems include label applicators that use pneumatic cylinders to press labels on as the items go by and label applicators that employ complex arrangements of electrical motors and mechanical components to apply the labels to the items. Moreover, in labeling devices that incorporate a printer, the label print speed must generally be matched to the speed of item conveyance for proper system operation. More specifically, the current state of the art is referred to as a "reels up" print and apply machine that dispenses the label directly onto the product from the printer. The product line speed must be synchronized with the print speed. If the product line is too slow, the label will bunch up (wrinkle). Conversely, if the product line is too fast, the label will be ripped out of the printer.

Additionally, label feedstock support shafts on current "reels up" print and apply machines are disposed vertically and utilize a label feedstock where the labels are orientated on the feedstock such that the long axis of the label, typically 4", is aligned with the feed direction. This configuration results in several drawbacks, including inefficiencies in production line space and label feedstock rolls, increased wear on the machine due to the inefficiencies, and the label feedstock roll potentially "telescoping" when applied to the reel because it must be handled in a horizontal configuration. Also, because of the orientation of the labels on the feedstock relative to the printer, indicia, such as one dimensional (or 1D) barcodes, must be printed in a "ladder" manner, leading to poor print quality. Generally, one-dimensional (or 1D) barcodes systematically represent data by varying the widths and spacing of parallel lines.

It would be desirable to provide a label applying apparatus that enables label print speed to vary from the conveyance speed of items being labeled, efficient use of production line space and label feedstock rolls, and increased print quality.

SUMMARY

In one aspect, a method of printing and applying a label to an item moving in a conveyance direction along a conveyance path involves the steps of: utilizing a label stock having a liner with a plurality of labels thereon; moving the label stock along a label stock path in a feed direction past a printer to print a given one of the labels, wherein a parallel line bar code is printed on the given label and each line of the parallel line bar code runs parallel to the feed direction and the length of the liner; separating the given label from the liner and dispensing the given label out of the label stock path in a first direction onto a label applying belt system for movement of the label in a second direction, wherein the first direction is substantially perpendicular to the second direction, wherein the first direction is substantially perpendicular to the conveyance direction, and the second direction is either substantially parallel to the conveyance direction or includes a directional component that is substantially parallel to the conveyance direction; the label applying belt assembly moves the label into position to be contacted by the item moving in the conveyance direction for application of the label to the item as the item moves.

In another aspect, a method of printing and applying a label to an item moving in a conveyance direction along a conveyance path involves the steps of: utilizing a print and labeling assembly that includes a label stock path that feeds label stock past a printer to print on a label of the label stock to produce a printed label that is dispensed in a first direction onto a label applying belt that moves in a second direction, wherein the first direction is substantially perpendicular to the second direction such that the printed label moves onto the label applying belt from a lateral side of the label applying belt; and the label applying belt moves the printed label into position to engage with the item as it moves along the conveyance path.

In a further aspect, a label print and apply system includes a conveyor for moving items to be labeled in a conveyance direction. A label roll support shaft is oriented substantially horizontally, and a roll of label stock formed by a liner with a plurality of labels thereon is mounted for rotation on the label roll support shaft. A label printer positioned along a label stock path for printing labels of the label stock as the label stock moves along the label stock path past the label printer. A label separation station is positioned along the label stock path, and at which labels separate from the liner and are dispensed out of the label stock path in a first direction. A label applying belt system is positioned to receive labels as the labels are dispensed in the first direction, wherein the label applying belt system moves in a second direction that is substantially perpendicular to the first direction.

In one implementation of the foregoing aspect, the first direction is substantially perpendicular to the conveyance direction, and the second direction is either substantially parallel to the conveyance direction or includes a directional component that is substantially parallel to the conveyance direction. The label belt applying system is configured to move labels into position to be contacted by items moving in the conveyance direction for application of the labels to the items as the items move.

The details of one or more embodiments are set forth in the accompanying drawings and the description below. Other features, objects, and advantages will be apparent from the description and drawings, and from the claims.

DETAILED DESCRIPTION

Figure 1A:
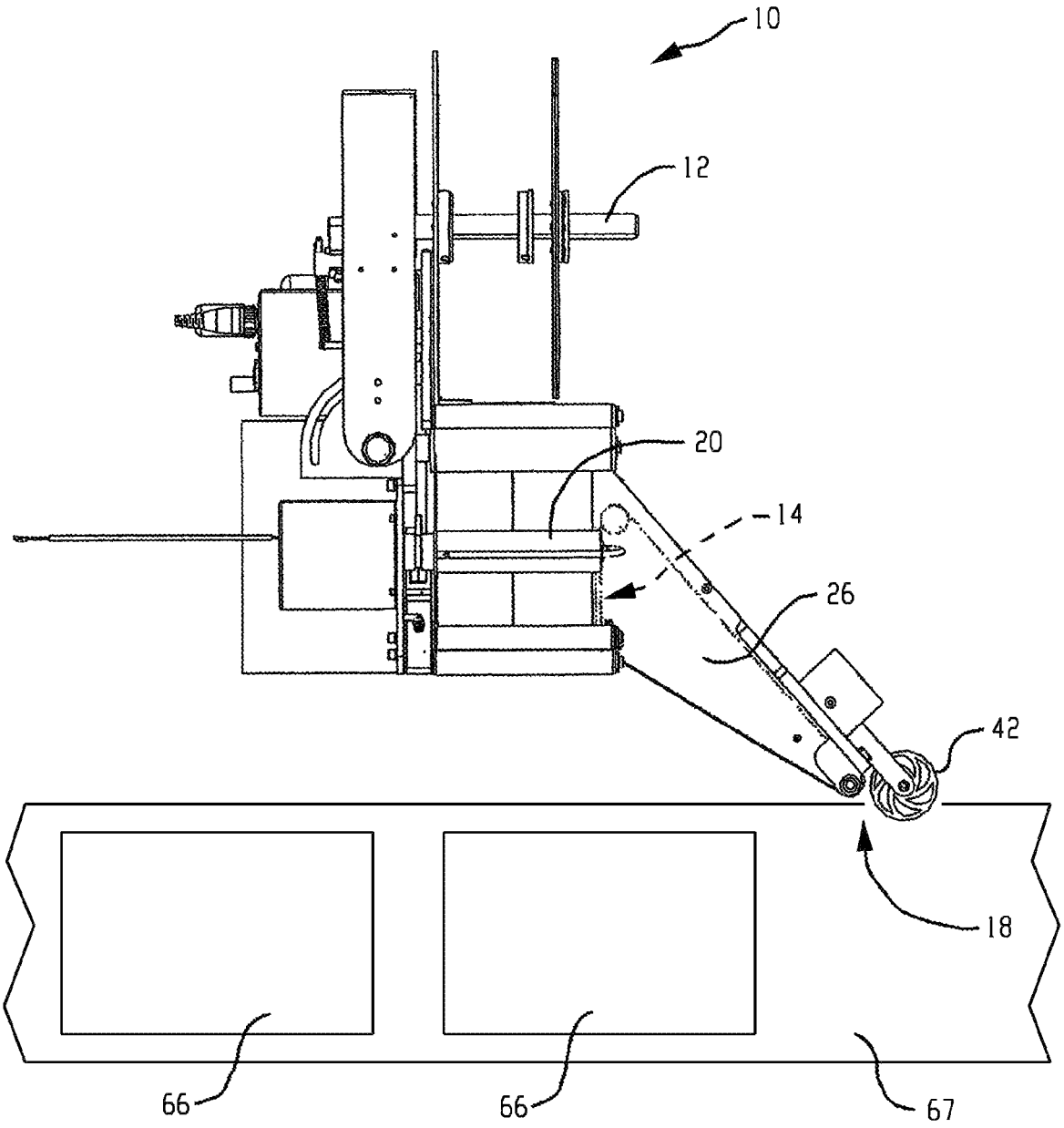
FIG. 1A shows a schematic top plan view of a print and label apparatus with associated item conveyor.
Figure 1B:
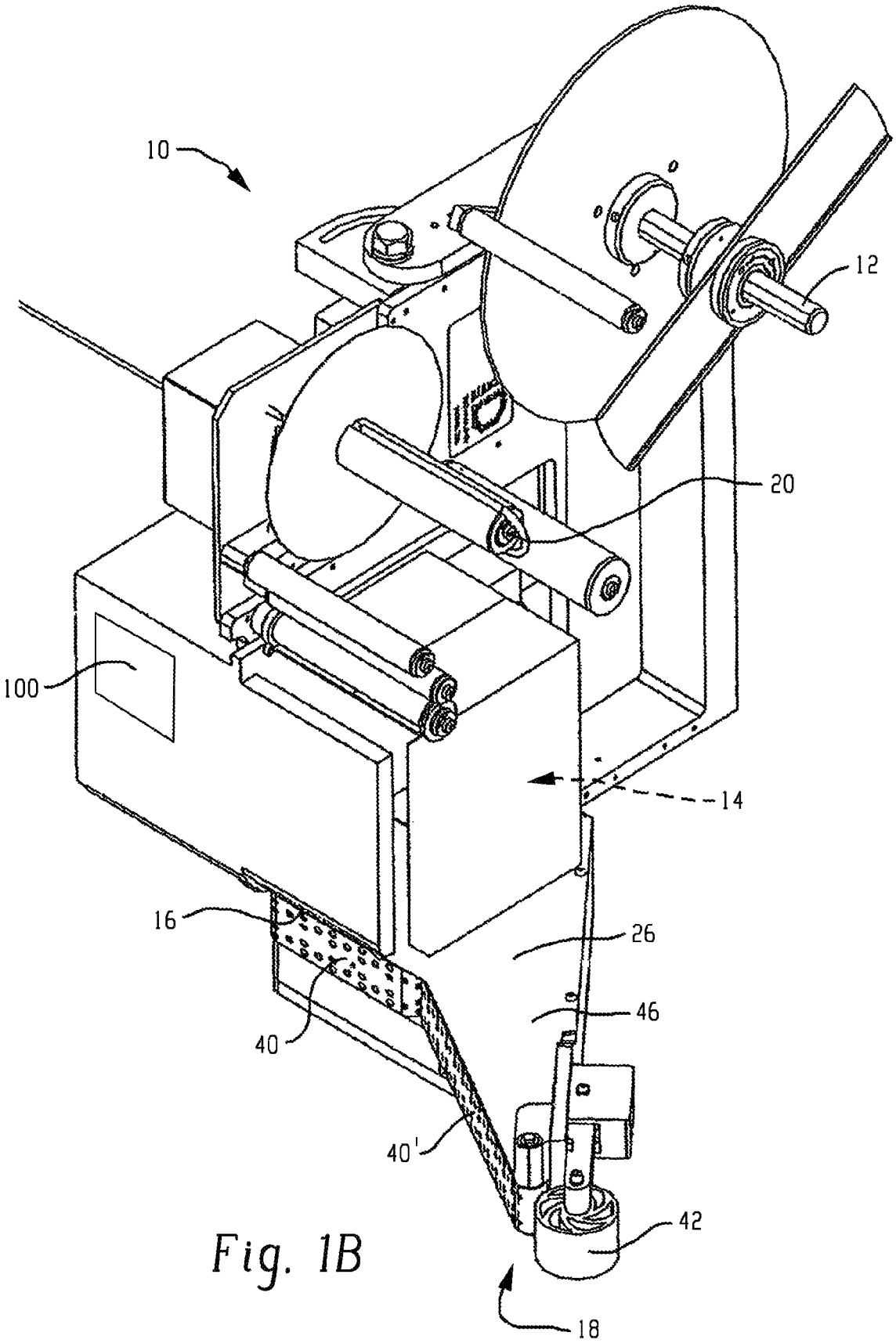
FIGS. 1B, 1C and 1D show perspective views of the print and label apparatus.
Figure 1C:
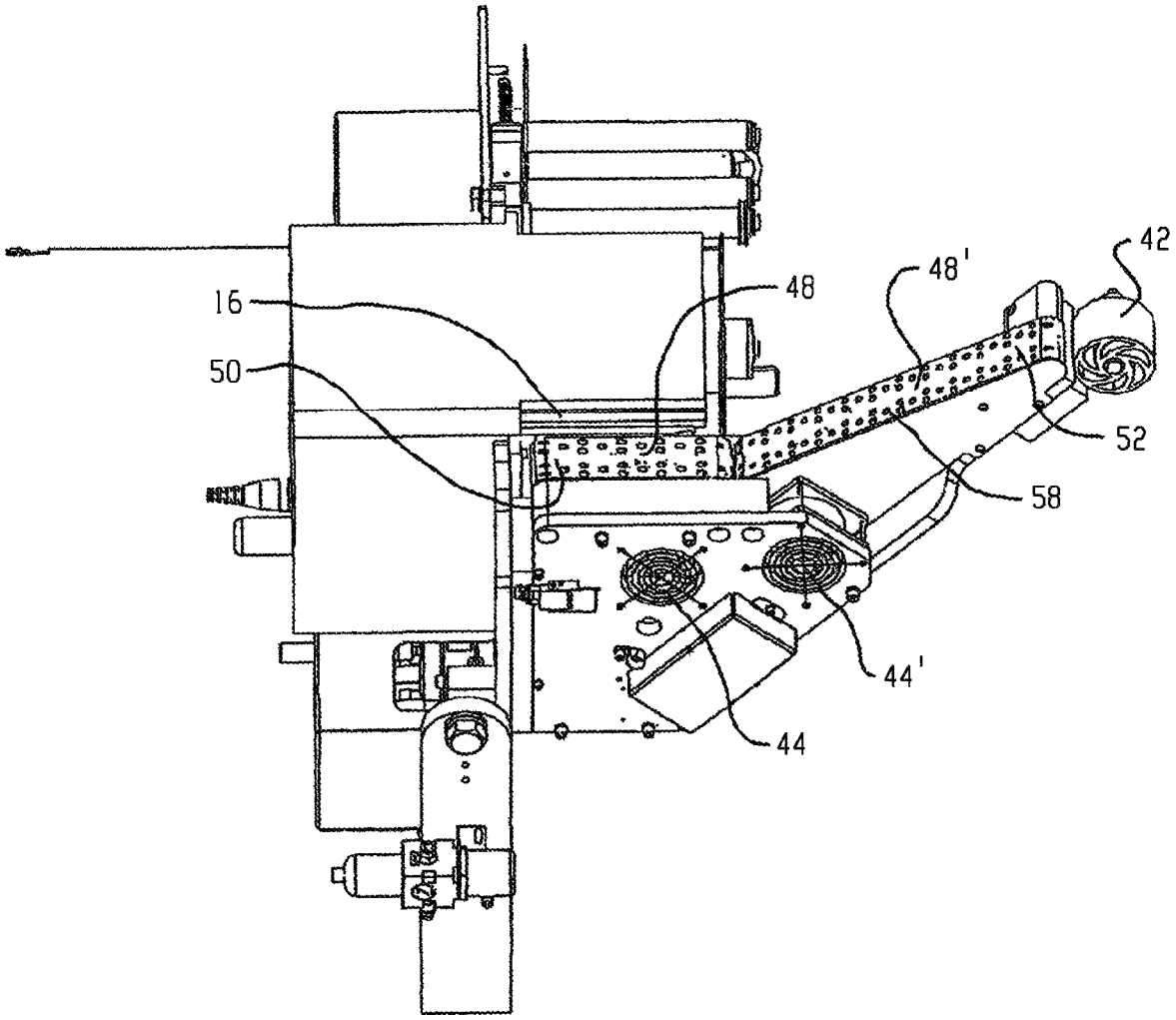
Figure 1D:
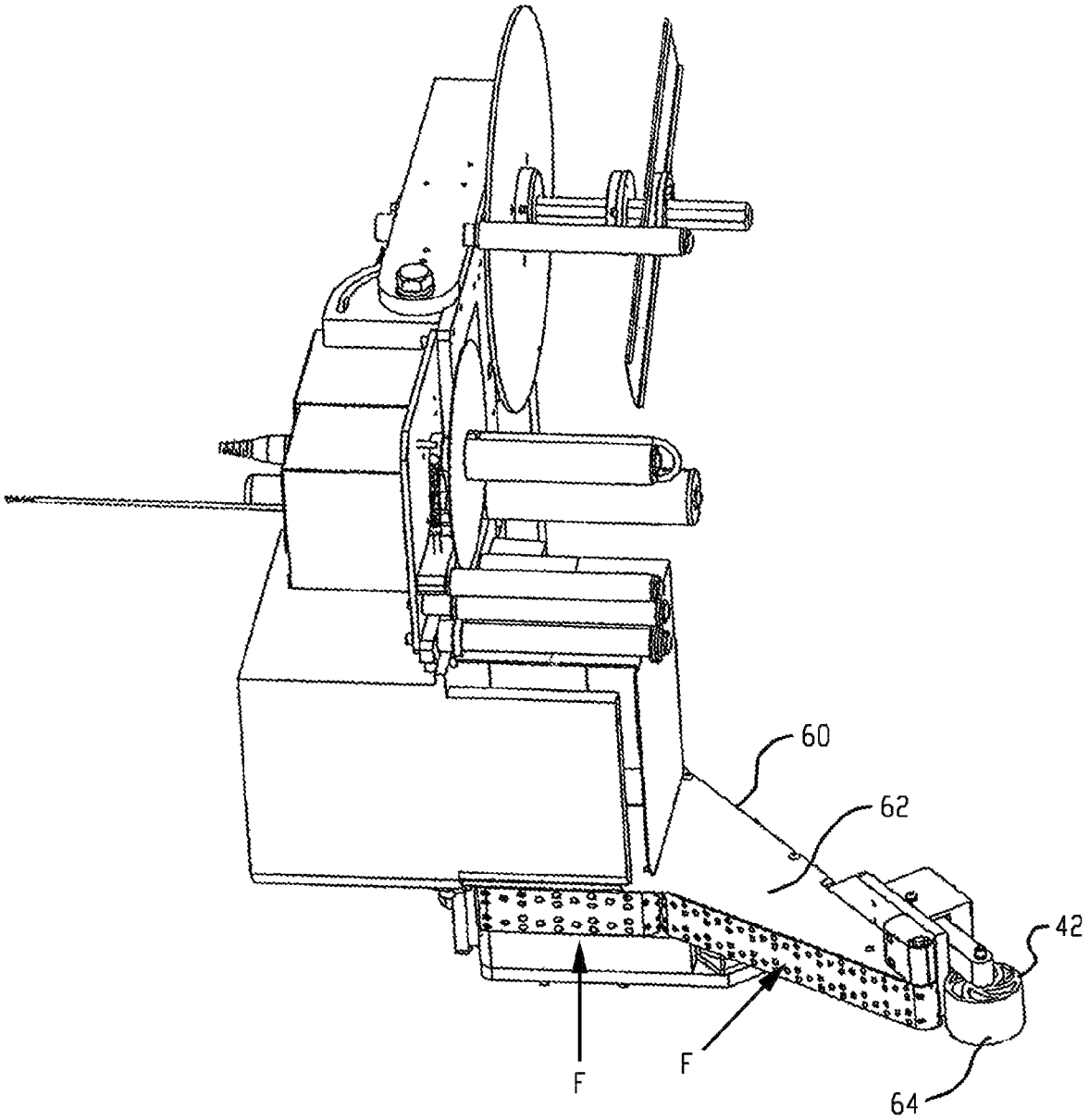

Referring to FIGS. 1A-D, a labeling apparatus 10 is disclosed for labeling moving items, which may, by way of example, include, but are not limited to, boxes, cartons, cases, containers, skids/pallets, packaging, plastic packaging, shrink-wrapped containers, or other items. The labeling apparatus 10 includes, in the operational configuration, a horizontally disposed label stock supply shall 12 (e.g., about which the label roll and/or a reel 13 that holds the label roll will rotate), a label printer 14 (disposed behind indicated plate), a label release mechanism 16, a label applying zone 18, and a horizontally disposed label backing/liner take-up shaft 20. In one embodiment, the label printer is a conventional print engine, which can print in thermal transfer or direct thermal mode. In some embodiments, the labeling apparatus 10 may be used to apply pre-printed labels, in which case the label printer 14 would be optional. In the labeling apparatus 10 of FIG. 1B, the label feedstock, which includes both a liner or backing 30 and multiple labels 28 applied to a release surface of the liner or backing, generally travels along the label stock path from the label stock supply reel 12, past the label printer 14 for printing and then by a release mechanism 16 (e.g., a peel bar or edge about which the label backing sharply turns to effect label release). A label feedstock drive arrangement (not shown) may include one or more motors that operate to rotate one or more rollers associated with one or more roller nips through which the label stock passes and/or operate to rotate the take-up reel 20. Once released, the label is then applied to a moving item by the label applying assembly 26 at the label applying zone 18. The label stock backing is then accumulated on the backing take-up reel 20.

Figure 2:
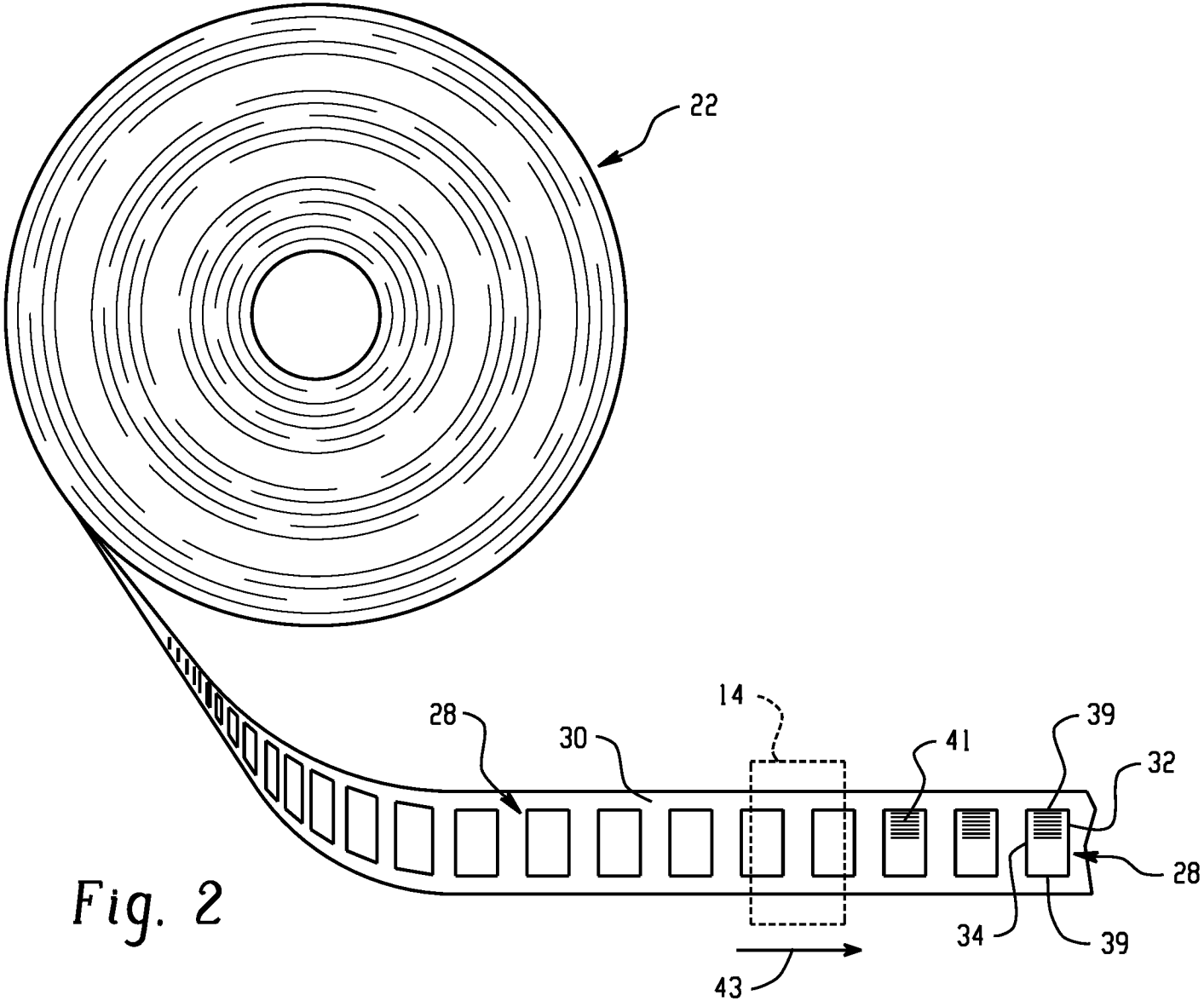
FIG. 2 shows a side view of a roll of label stock according to one embodiment.

FIG. 2 depicts an example of a roll of label stock 22 that may be applied to moving items using the label applying apparatus 10. The label stock 22 includes labels 28 removably/releaseably coupled to a backing 30 (also referred to as liner or label stock backing) that facilitates conveyance of the labels 28 through the labeling apparatus 10. Each label 28 has a leading edge 32, which is the first edge of the label 28 to travel along the label stock path 24, a trailing edge 34, which is the last edge of the label 28 to travel along the label stock path 24, and side edges 39. In various embodiments, the dimension of the leading and trailing edges are greater than the dimensions of the side edges. In one embodiment, the leading and trailing edges are about 4" in dimension while the sides edges are about 2" in dimension, but other variations are possible. The dimension of the leading and trailing edges of the label defines the label width, and the dimension of the side edges of the label define the label height (i.e., label height runs substantially parallel to the length of the label stock liner). This is in contrast to conventional print and apply machines which typically use a label stock where the labels are arranged with their long axis being parallel to the feed direction, and typically correspond to sides edges of 4" and leading/trailing edges of 2". Thus, the present design not only allows for twice as many labels on a label stock roll of any given diameter, the described machine also provides an increase in the effective output of the machine. This is because the maximum throughput is limited by the maximum practical print speed of the printer, and the feed length of labels running on the described machine is half the feed length of a conventional print and apply machine. Furthermore, because the described labels are being printed in "landscape" format, indicia, such as barcodes, are printed in a "picket-fence" format, that is, the parallel lines of each barcode 41 are printed parallel to the direction 43 of label stock movement past the label printer 41. The presently described machine thus also provides increased print quality. Also, because the label feed length during printing is half of what is required in conventional print and apply machines, the useful life of wear parts is doubled.

The labels 28 may generally be pressure sensitive adhesive labels having an adhesive label side facing the liner prior to separation from the liner, such adhesive side for engagement of the label 28 with the moving item intended to be labeled, and a non-adhesive label side that is generally the printed side. The non-adhesive label side may be a printable substrate, a non-printable substrate, or a pre-printed surface. In other embodiments, the label stock 22 used may be liner-less label stock, in which case the label release mechanism 16 may operate to separate each label from the trailing length of label stock 22.

The label applying assembly 26 may be of module configuration, enabling it to be installed and removed from the apparatus 10 without impacting the function or operation of the other parts of the apparatus. Importantly, the label applying assemble 26 provides a "buffer" between the printer and the application point, so that the print speed and the product speed do not have to be synchronized because the two processes are decoupled. Conversely, conventional print and apply machines dispense the label directly onto the product from the printer, requiring the product speed to be synchronized with the print speed. If the product speed is too slow, the label will bunch up (wrinkle), and if the product speed is too fast, the label will be ripped out of the printer.

The label applying belt assembly or system 26, which may also be referred to herein as a label merge module in the alternative, includes a first conveyor 40, a second conveyor 40', a roller 42, at least a first fan 44, and a plenum 46 (internal of the assembly housing). The first and second conveyors 40, 40' have a support surface 48, 48' positioned to receive a label 28 that has been released from the backing 30, an upstream end 50 positioned proximate to the label release mechanism 16, and a downstream end 52 positioned proximate to the roller 42. The conveyor 40, 40' has one or more openings 58 to enable a negative pressure effect to occur at the support surface 48. The openings 58 can have any convenient shape, which can include, but is not limited to, circular, slotted, elliptical, square, rectangular, other shape, or combinations thereof. As shown, the conveyor 40, 40' can have a plurality of openings 58 arranged as rows of evenly spaced slots. In other embodiments, the shape and orientation of the openings 58 in the plate 40 may vary. The primary portion of the conveyor 40, 40' defining the support surface 48 may typically be planar as shown, but other variations are possible including conveyor configurations that result in some curvature in the support surface 48 and/or one or more angle changes in the support surface 48. The conveyor 40 may have any convenient thickness ranging from a thin plate to a thick plate.

As shown, the fan 44 is positioned to draw an air flow F through the openings 58 in the conveyor 40, 40', which air flow passes through the plenum 46 and is then exhausted from another side of the assembly. By drawing the air flow F through the openings 58 in the conveyor 40, 40', the fan 44 creates a negative pressure effect at the support surface 48 of the conveyor 40, 40'. The fan 44 can be any convenient type or size of commercially available fan. The plenum 46 is defined by the rear surface 56 of the conveyor 40, 40', an end wall 60 opposite the conveyor 40, 40', and a plurality of side walls 62 extending from the conveyor 40, 40' to the end wall 60. It is recognized that the fan 44 may be positioned in any one of the plurality of side walls 62 or in the end wall 60. The plenum 46 may be sealed to prevent air leakage, but embodiments having some air leakage may also be implemented. Although the use of a fan is described above, alternative means for creating a negative pressure effect at the support surface 48 of the conveyor 40, 40' may be used, which may include any means of creating a negative pressure known in the art. Such means for creating a negative pressure effect at the support surface 48 may include a Venturi apparatus, a vacuum pump, or other device capable of creating a negative pressure effect at the support surface 48 by drawing air through the openings 58 in the conveyor 40, 40'.

Figure 3:
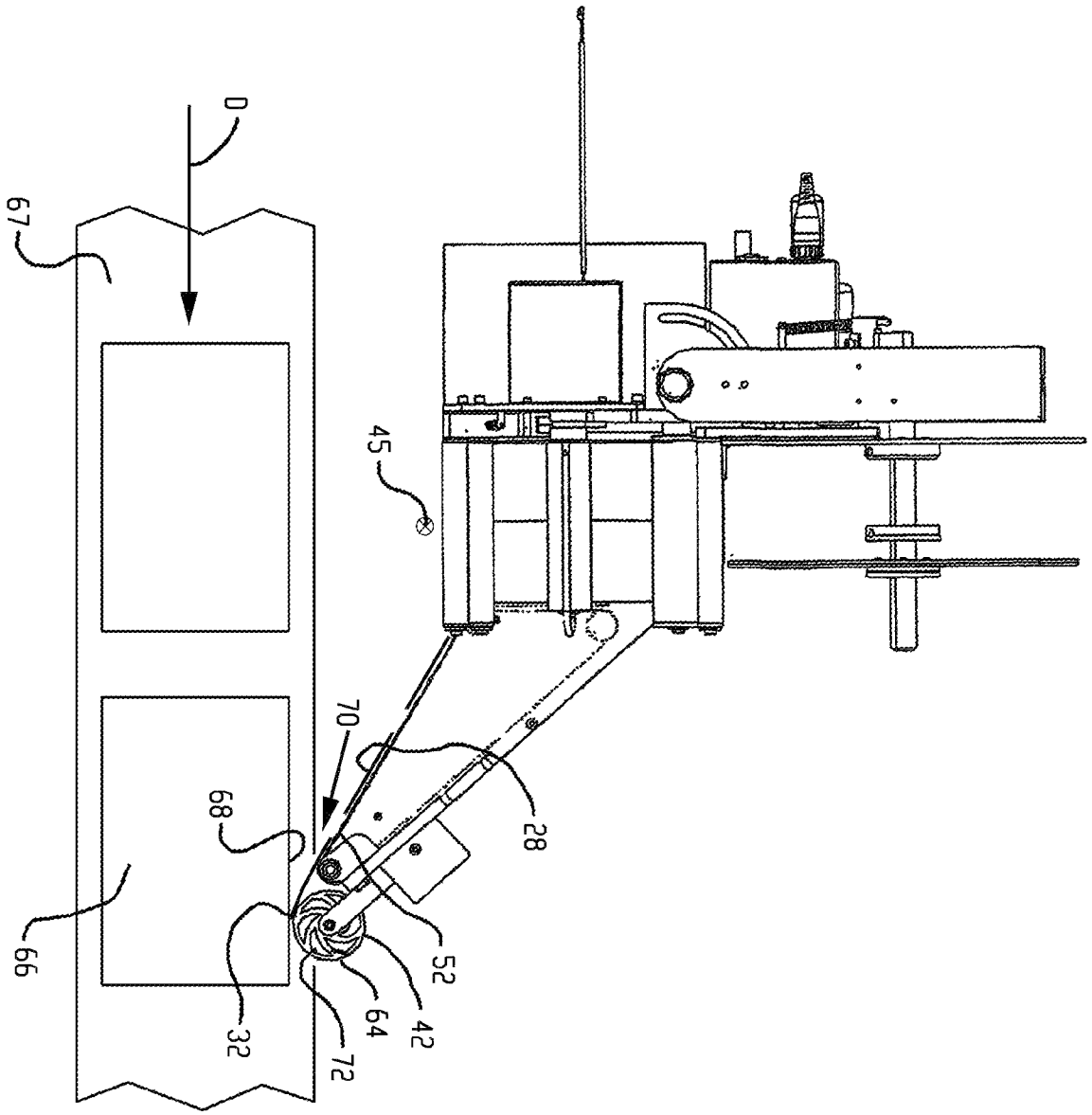
FIG. 3 shows a top view of one embodiment of a label print and apply apparatus labeling a moving item.

As shown in FIG. 3, the roller 42 is positioned proximate to the downstream end 52 of the conveyor 40, 40'. The roller 42 is free-spinning and has an outer surface portion 64 that is positioned proximate to a moving item 66 (e.g., moved along by a conveyor 67) to be labeled such that the outer surface portion 64 is in contact with an application surface 68 of the moving item 66 (also referred to herein as a moving item application surface). Contact between the outer surface portion 64 of the roller 42 and the application surface 68 of the moving item 66 creates a nip zone 70 where the outer surface portion 64 contacts the application surface 68. The nip zone 70 receives the leading edge 32 of a label 28 and pulls the label 28 forward into contact with the application surface 68 of the moving item 66. Because the roller 42 is free-spinning, contact between the outer surface portion 64 of the roller 42 and the application surface 68 of the moving item 66 causes a speed of the label 28 to be matched to a speed of the application surface 68 of the moving item 66 when the label 28 enters the nip zone 70. The free-spinning roller 42 matches the speed of the label 28 to the speed of the application surface 68 without having to synchronize the speed of the label 28 (or the speed of label printer in embodiments using a label printer) with the speed of the moving item 66 using electric motors, timers, controllers and other electronic equipment.

The outer surface portion 64 of the roller 42 may be compliant such that it conforms to irregular surfaces and/or varying distances. The outer surface portion 64 of the roller 42 may also be resilient so that the outer surface portion 64 durably and consistently re-conforms to an original shape in response to any deformation. The compliant and resilient properties of the outer surface portion 64 of the roller 42 allows the passing application surface 68 of the moving item 66 to partially displace the outer surface portion 64 of the roller 42, which re-conforms after the application surface 68 has passed. A roller 42 having an outer surface portion 64 that is compliant and/or resilient may also be referred to herein in the alternative as a compliant roller without implying a lack of resilience. The outer surface portion 64 of the roller 42 may also be non-stick so that adhesive and/or label faults do not accumulate on the outer surface portion 64 of the roller 42 to impede performance. The outer surface portion 64 of the roller 42 may be made from a resilient material, such as plastic, rubber, silicone rubber, or foam, for example. One or more surface treatments may be applied to the outer surface portion 64 to provide non-stick properties to the roller 42. In one embodiment, the outer surface portion 64 of the roller 42 may be a highly resilient, non-stick silicone rubber. In some embodiments, the roller 42 may have hollow windows 72 extending lengthwise through the roller 42, the windows 72 enabling the outer surface portion 64 to deform towards a central axis of the roller 42 to provide resilience. In operation, the application surface 68 of the moving item 66 partially displaces the outer surface portion 64 of the roller 42, which may deform. Because of the resilient nature of the roller 42, the outer surface portion 64 of the roller 42 seeks to maintain its original shape and exerts a force back against the application surface 68 of the moving item 66, When a label 28 moves through the nip zone 70, this force acts on the label 28, pressing the adhesive label side against the application surface 68 to adhere the label 28 to the moving item 66. Also due to the resilience of the roller 42, a degree of displacement/deformation of the outer surface portion 64 of the roller 42 constantly changes in response to changes in a contour of the application surface 68 of the moving item 66. This dynamic nature of the outer surface portion 64 of the roller 42 enables the roller 42 to maintain contact with the application surface 68 of the moving item 66 despite one or more contour irregularities in the application surface 68 and allows smooth application of the label 28 to the application surface 68.

Also, and as shown in FIG. 3, the space in a label applying line occupied by the described apparatus is minimized because, as described in detail above, the prior print and apply machines have a "reels up" configuration, which would roughly equate with moving the described apparatus on its side with the label stock supply shaft and label backing take-up shaft disposed vertically. But with the present design, the label stock supply shaft and label backing take-up shaft are disposed horizontally, resulting in the reels and labels rolls being oriented vertically, with the result being a decrease in the effective processing line space occupied by the described apparatus, thus increasing efficiency of the processing line.

Figure 4:
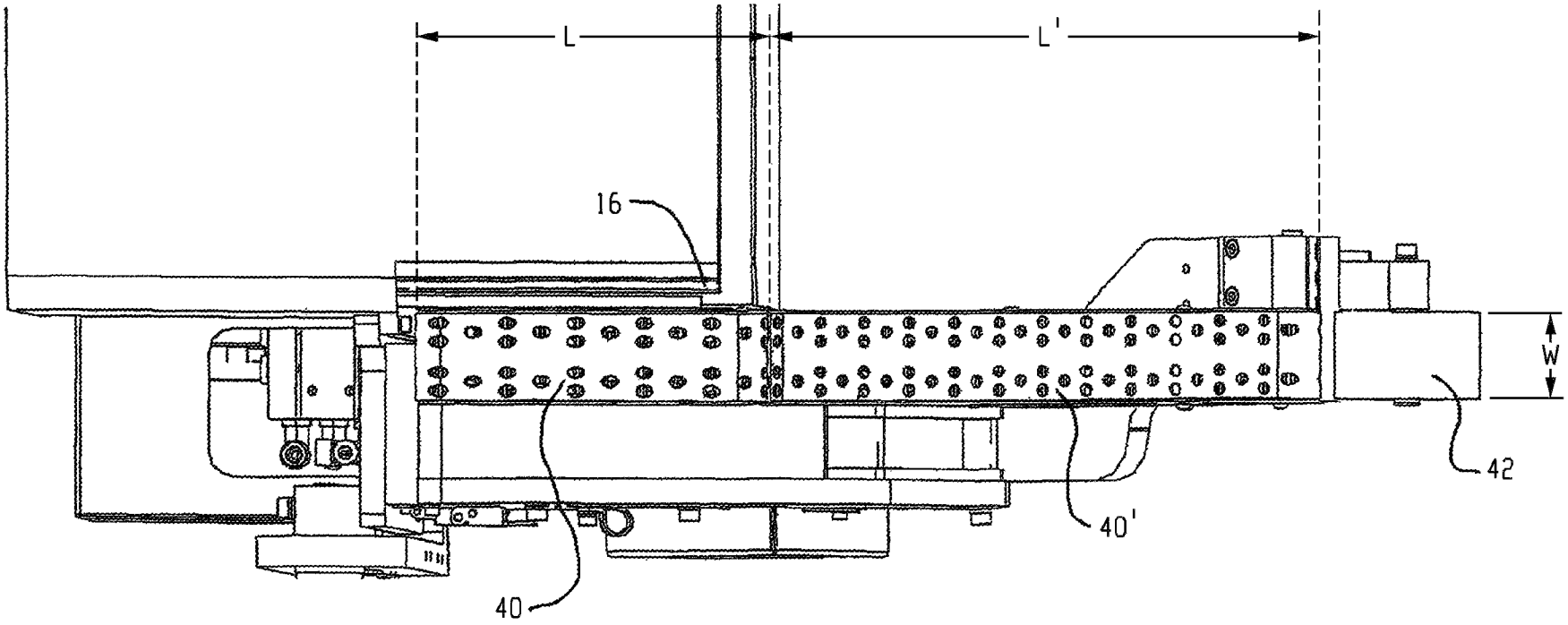
FIG. 4 shows a partial elevation view of the label print and apply apparatus.

As shown in FIG. 4, the conveyors 40, 40' are positioned to extend from the release mechanism 16 to the roller 42. The conveyors 40, 40' have a width W in a direction generally parallel to a rotational axis of the roller 42, and the width W may be selected to adequately support a lateral dimension of the label 28 (lateral referring to a cross-machine direction). The conveyor 40 has a length L in a direction generally parallel to the item conveyance direction D (FIG. 3) and conveyor 40' has a length L' in a direction angled toward the path of the moving item, where direction L' has a directional component parallel to the conveyance direction D.

Figure 5:
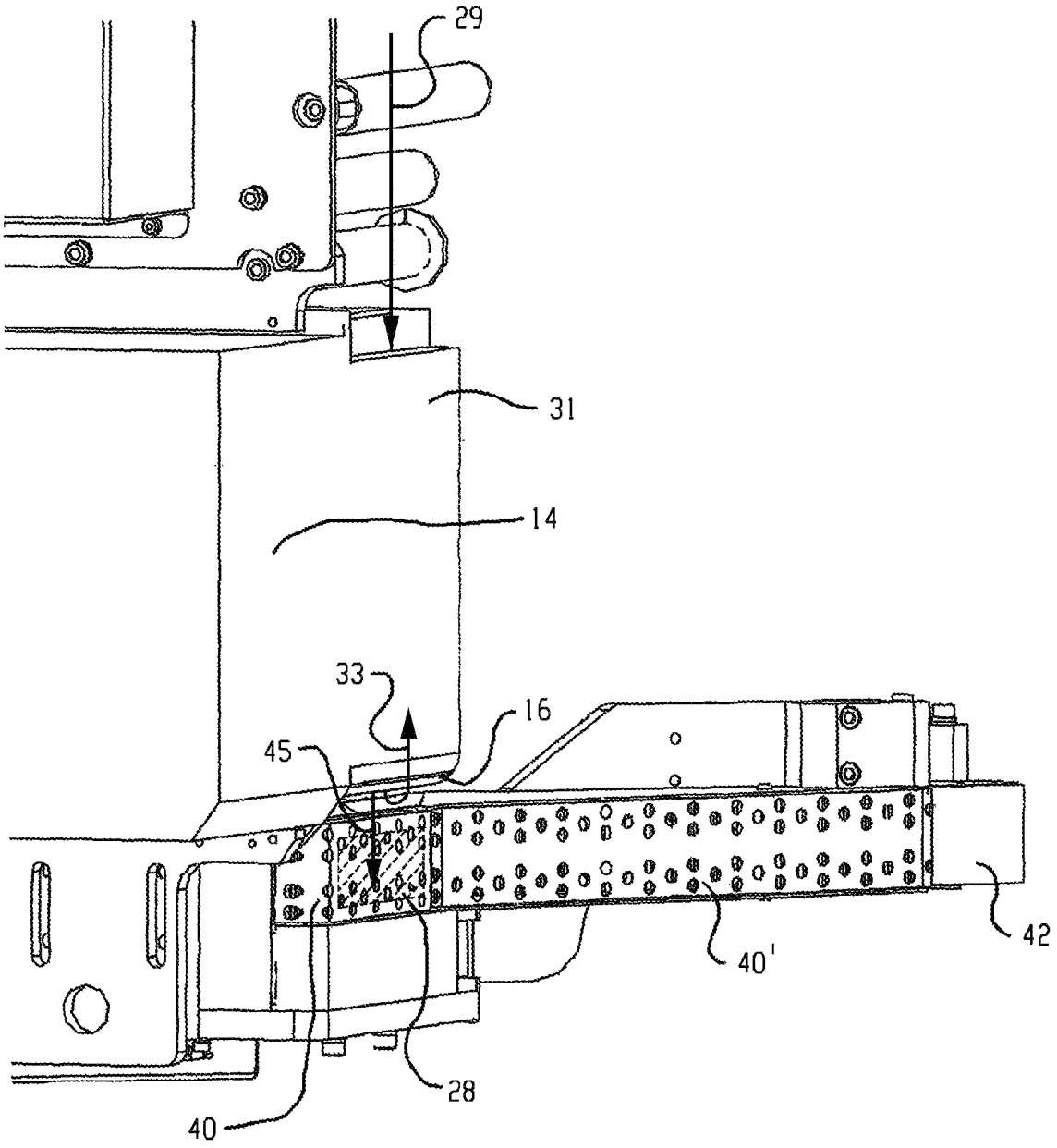
FIG. 5 shows a front perspective view of one embodiment of the label print and apply apparatus.

As shown in FIG. 5, the label stock 22, which includes labels 28 removably/releaseably coupled to a backing 30, travels in direction 29 behind plate 31 where indicia is printed on the labels 28 by the printer 14 (also behind plate 31). The printed labels 28 then continue traveling along direction 29 until they reach the label release mechanism 16 where the label stock 22 passes tightly over the release mechanism 16, and the tight travel path of the label stock 22 around the release mechanism 16 causes the leading edge 32 of the label 28 to separate from the label stock backing 30. The leading edge 32 of the label 28 continues to travel downward in direction 45 (into the paper in FIG. 3) towards the conveyor 40 as the label 28 continues to release from the label stock backing 30. The adhesive label side of the label 28 faces generally away from the support surface 48 of the conveyor 40. The backing 30 travels upward along direction 33, and onto the backing take up reel 20. Label stock 22 is fed by the label drive mechanism (not shown) from the label stock supply reel (not shown) to the label printer 14 (behind plate 31). The label release mechanism 16 may include, but is not limited to, a release bar, release roller, release plate, peel bar, peel edge, or other release mechanism.

The fan 44 creates an air flow through the openings 58 in the conveyor 40, 40', and the air flow in turn creates a negative pressure effect (partial vacuum effect) along the support surface 48 of the conveyor 40, 40'. The negative pressure effect at the support surface 48 maintains the label 28 in contact with the support surface 48 and keeps the label 28 straight as the label 28 moves along the label release path.

A controller 100 is provided for controlling the various components. The controller may take on various forms, incorporating electrical and electronic circuitry and/or other components. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the device or the control functions of any component thereof.

Figure 6:
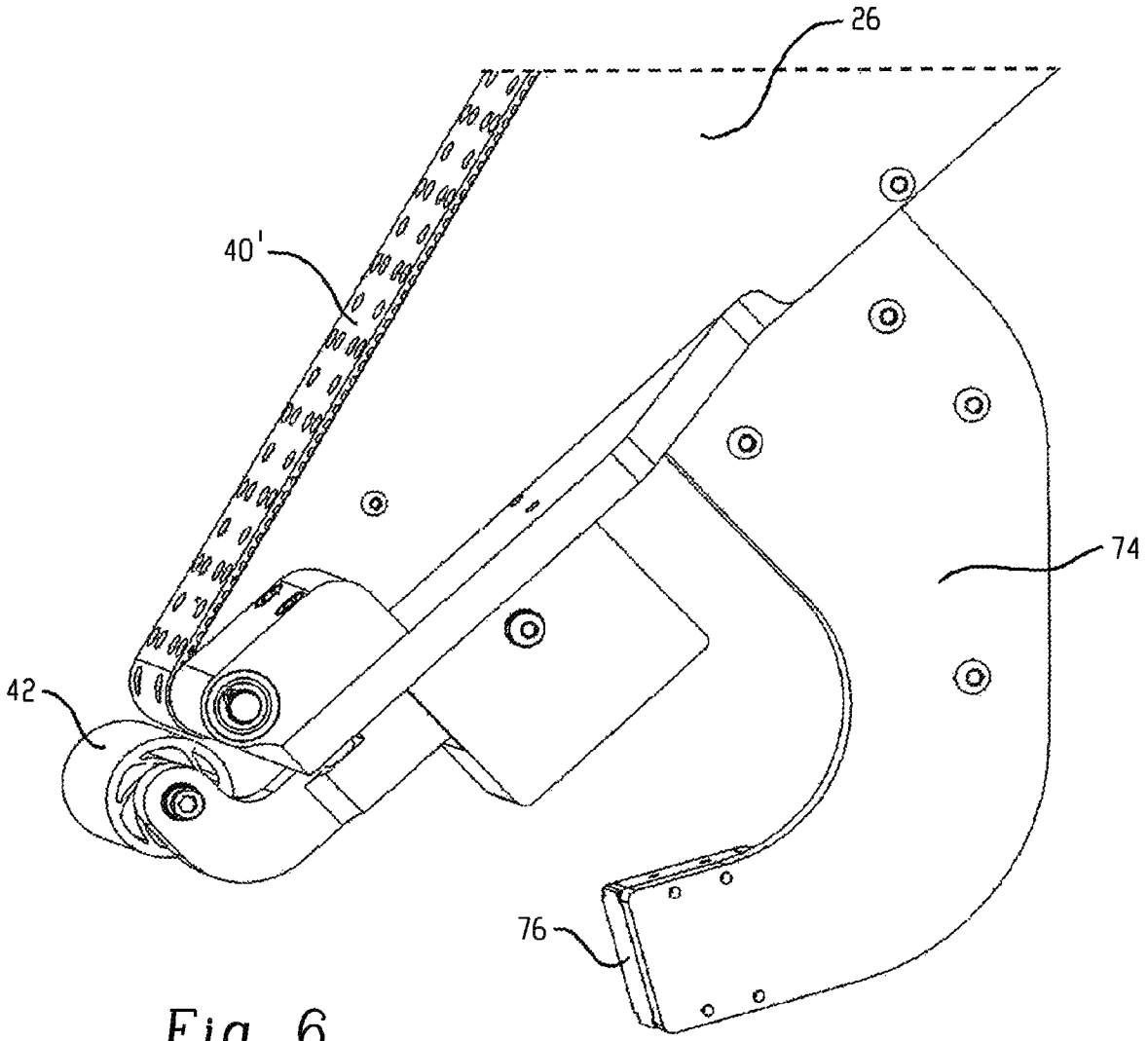
FIG. 6 shows a partial top view of the label print and apply apparatus, according to one embodiment.
Figure 7:
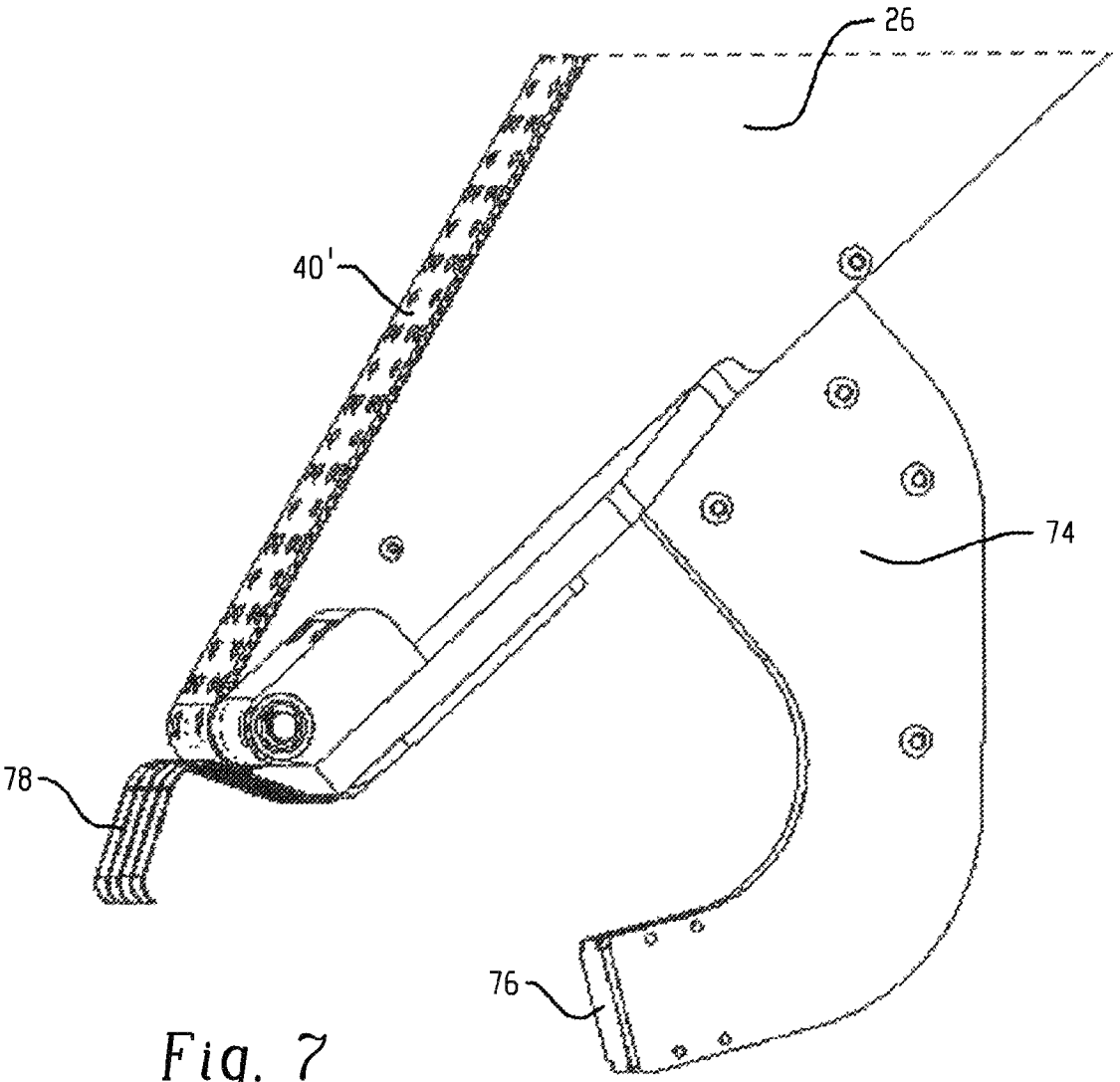
FIG. 7 shows a partial op view of the label print and apply apparatus, according to one embodiment.

As shown in FIG. 6, in an additional embodiment, a sensor support arm 74 is positioned on the rear, e.g., non-conveyor side, of the label applying assembly 26. In one embodiment, the sensor support arm 74 generally has a curved shape such that a terminal end of the sensor support arm 74 is directed to a position which is downstream of the roller 42, thus enabling a sensor 76 positioned at the terminal end of the sensor support arm 74 to detect proper application of the label 28 to the moving item 66. In one embodiment, the sensor 76 is a camera. In one embodiment, a second sensor is placed behind conveyor 40' to detect proper release of the label 28 from the conveyor 40'. In one embodiment, the second sensor is an optical sensor. In one embodiment, the second sensor and sensor 76 is employed.

As shown in 7, in an additional embodiment, roller 42 is replaced with a plurality of fingers 78. The fingers 78 have a medial flat portion that is positioned proximate to a moving item 66 (e.g., moved along by a conveyor 67) to be labeled such that the medial flat portion is in contact with an application surface 68 of the moving item 66 (also referred to herein as a moving item application surface). Contact between the medial flat portion of the fingers 78 and the application surface 68 of the moving item 66 creates a nip zone where the medial flat portion contacts the application surface 68. The nip zone receives the leading edge 32 of a label 28 and pulls the label 28 forward into contact with the application surface 68 of the moving item 66. In one embodiment, the fingers 78 are flexible, such that they may flex during application of the label 28. In one embodiment, the fingers 78 are metal.

Figure 8:
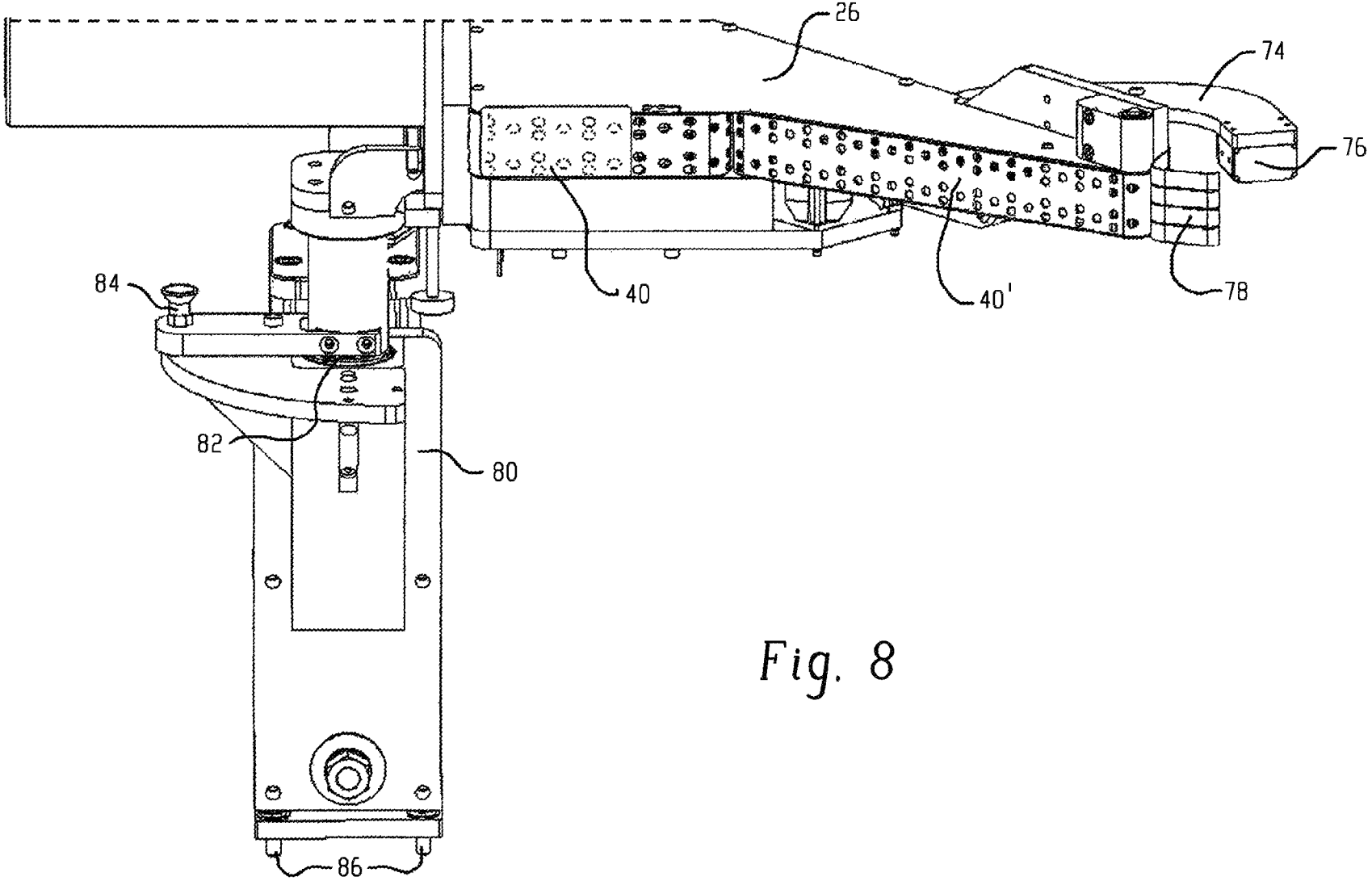
FIG. 8 shows a partial side view of the label print and apply apparatus, according to one embodiment.

As shown in FIG. 8, in an additional embodiment, the labeling apparatus 10 includes a stand 80 which is used to mount the labeling apparatus 10. In one embodiment, the stand 80 comprises a main body which may be fixed to a surface, such as a floor, via attachment points 86. In one embodiment, the attachment points 86 are bolts. In one embodiment, the stand 80 comprises a pivot point 82, such that the labeling apparatus 10 may be rotated about a vertical axis. In addition, the stand 80 may comprise a locking mechanism 84 for locking the rotation of the labeling apparatus 80 at a desired position.

Thus, the described embodiment provides a label print and apply system that includes a conveyor for moving items to be labeled in a conveyance direction. A label roll support shaft is oriented substantially horizontally, and a roll of label stock formed by a liner with a plurality of labels thereon is mounted for rotation on the label roll support reel. A label printer positioned along a label stock path for printing labels of the label stock as the label stock moves along the label stock path past the label printer. A label separation station is positioned along the label stock path, and at which labels separate from the liner and are dispensed out of the label stock path in a first direction. A label applying belt system is positioned to receive labels as the labels are dispensed in the first direction, wherein the label applying belt system moves in a second direction that is substantially perpendicular to the first direction. The first direction is substantially perpendicular to the conveyance direction, and the second direction is either substantially parallel to the conveyance direction or includes a directional component that is substantially parallel to the conveyance direction. The label belt applying system is configured to move labels into position to be contacted by items moving in the conveyance direction for application of the labels to the items as the items move. The described embodiment also provides a method of printing and applying a label to an item moving m a conveyance direction along a conveyance path. The method involves the steps of: utilizing a label stock having a liner with a plurality of labels thereon, wherein the liner has a length and a width, and each label on the liner has a height that runs parallel to the length of the liner and a width that runs parallel to the width of the liner, and the width of each label is at least 1.5 times greater than the height of each label; moving the label stock along a label stock path in a feed direction past a printer to print a given one of the labels, wherein a parallel line bar code is printed on the given label and each line of the parallel line bar code runs parallel to the feed direction and the length of the liner; separating the given label from the liner and dispensing the given label out of the label stock path in a first direction onto a label applying belt system for movement of the label a second direction, wherein the first direction is substantially perpendicular to the second direction, wherein the first direction is substantially perpendicular to the conveyance direction, and the second direction is either substantially parallel to the conveyance direction or includes a directional component that is substantially parallel to the conveyance direction; the label applying belt assembly moves the label into position to be contacted by the item moving in the conveyance direction for application of the label to the item as the item moves.

The foregoing is provided for purposes of illustrating, explaining, and describing embodiments of labeling apparatus. Modifications and adaptations to these embodiments will be apparent to those skilled in the art and may be made without departing from the scope or spirit of this application.

What is claimed is:

1. A method of printing and applying a label to an item moving in a conveyance direction along a conveyance path, the method comprising:

utilizing a label stock having a liner with a plurality of labels thereon;

moving the label stock along a label stock path in a feed direction past a printer to print a given one of the labels, wherein a parallel line bar code is printed on the given label and each line of the parallel line bar code runs parallel to the feed direction and the length of the liner;

after printing of the parallel line bar code on the given label, separating the given label from the liner and dispensing the given label out of the label stock path in a first direction onto a label applying belt system for movement of the label in a second direction, wherein the first direction is substantially perpendicular to the second direction, wherein the first direction is substantially perpendicular to the conveyance direction, and the second direction is either substantially parallel to the conveyance direction or includes a directional component that is substantially parallel to the conveyance direction;

the label applying belt system moves the label into position to be contacted by the item moving in the conveyance direction for application of the label to the item as the item moves.

2. The method of claim 1, wherein the liner has a length and a width, and each label on the liner has a height that runs parallel to the length of the liner and a width that runs parallel to the width of the liner, and the width of each label is at least 1.5 times greater than the height of each label.

3. A method of printing and applying a label to an item moving in a conveyance direction along a conveyance path, the method comprising:

utilizing a print and labeling assembly that includes a label stock path that feeds label stock past a printer to print on a label of the label stock to produce a printed label that is then separated from a liner of the label stock and dispensed in a first direction onto a label applying belt that moves in a second direction, wherein the first direction is substantially perpendicular to the second direction such that the printed label moves onto the label applying belt from a lateral side of the label applying belt; and the label applying belt moves the printed label into position to engage with the item as it moves along the conveyance path;

wherein a feed rate of the label stock past the printer during printing is less than a conveyance rate of the label applying belt, and the printed label fully releases from the label stock before engaging onto the label applying belt.

4. The method of claim 3, wherein the first direction is substantially perpendicular to the conveyance direction and the second direction is either substantially parallel to the conveyance direction or includes a directional component that is substantially parallel to the conveyance direction.

5. The method of claim 3, wherein the label stock has a length and a width, and each label on the label stock has a height that runs parallel to the length of the label stock and a width the runs parallel to the width of the label stock, and the width of each label is at least 1.5 times greater than the height of each label.

6. The method of claim 5, wherein a barcode is printed on the label, wherein lines of the barcode are printed in an orientation that is parallel to a movement direction of the label past the printer, such that that each line of the barcode is oriented perpendicular to the width of the label.

7. The method of claim 3 wherein the conveyance rate of the label applying belt is substantially the same as a conveyance rate of the item along the conveyance path.

8. The method of claim 3 wherein the label stock is fed from a label stock roll that is mounted on a label stock support shaft of the print and labeling assembly, wherein the label stock support shaft extends in a substantially horizontal direction.

9. The method of claim 3 wherein the first direction runs substantially vertically downward, the second direction runs substantially horizontal and the conveyance direction runs substantially horizontal.

10. A label print and apply system for use in applying labels to items moving in a conveyance direction, comprising:

a label roll support shaft oriented substantially horizontally;

a roll of label stock formed by a liner with a plurality of labels thereon, wherein the roll of label stock is mounted for rotation on the label roll support shaft;

a label stock path along which the label stock moves;

a label printer positioned along the label stock path for printing on labels of the label stock as the label stock moves along the label stock path past the label printer to produce printed labels;

a label separation station downstream of the label printer along the label stock path at which printed labels separate from the liner and are dispensed out of the label stock path in a first direction;

a label applying belt system positioned to receive printed labels as the printed labels are dispensed in the first direction, wherein the label applying belt system moves in a second direction that is substantially perpendicular to the first direction.

11. The label print and apply system of claim 10, wherein the first direction is substantially perpendicular to the conveyance direction, and the second direction is either substantially parallel to the conveyance direction or includes a directional component that is substantially parallel to the conveyance direction;

wherein the label applying belt system is configured to move printed labels into position to be contacted by items moving in the conveyance direction for application of the printed labels to the items as the items move.

12. The label print and apply system of claim 10, wherein the liner has a length and a width, and each label on the liner has a height that runs parallel to the length of the liner and a width that runs parallel to the width of the liner, and the width of each label is at least 1.5 times greater than the height of each label.

13. The label print and apply system of claim 12, further comprising a controller for controlling the label printer, wherein the controller is configured to cause the label printer to print a parallel line bar code on each label, and each line of the parallel line bar code runs parallel to a feed direction of the label stock past the label printer and parallel to the length of the liner.

14. The label print and apply system of claim 13 wherein the feed direction is substantially perpendicular to the conveyance direction.

15. The label print and apply system of claim 10 wherein the label applying belt system includes at least one vacuum belt.

16. The label print and apply system of claim 10, wherein a printing speed of each label printed by the label printer is decoupled from a speed of application of the printed label to the moving item.

17. The label print and apply system of claim 16, wherein due to the decoupling, a speed of the label printer and a speed of the moving item do not have to be synchronized.

18. The label print and apply system of claim 10, further comprising a label stock drive arrangement for moving the label stock along the label stock path.

19. The label print and apply system of claim 18, wherein a linear speed of the label stock drive arrangement does not match a linear speed of item movement in the conveyance direction.

* * * * *